US006041858A

United States Patent [19]

Arizmendi

[11] Patent Number: 6,041,858

[45] Date of Patent: Mar. 28, 2000

[54] HIGH EXPANSION DOWNHOLE PACKER

[75] Inventor: Napoleon Arizmendi, Magnolia, Tex.

[73] Assignee: PES, Inc., The Woodlands, Tex.

[21] Appl. No.: 08/944,061

[22] Filed: Sep. 27, 1997

[51] Int. Cl.[7] ..... E21B 33/127

[52] U.S. Cl. ..... 166/187; 277/331

[58] Field of Search ..... 166/187, 387; 277/331, 333

[56] References Cited

U.S. PATENT DOCUMENTS

| | | | |
|---|---|---|---|
| 2,781,852 | 2/1957 | Rumble | 166/120 |
| 2,815,817 | 12/1957 | Conrad | 277/333 |
| 3,578,083 | 5/1971 | Anderson | 166/285 |
| 3,724,550 | 4/1973 | Lanmon, II | 166/285 |
| 5,775,429 | 7/1998 | Arizmendi et al. | 166/387 |

*Primary Examiner*—David Bagnell
*Assistant Examiner*—Chi H. Kang
*Attorney, Agent, or Firm*—Alan J. Atkinson

[57] ABSTRACT

An expandable apparatus for sealing a space downhole in a wellbore. The apparatus has an expandable body having a hollow interior for defining an open flow path. A deformable material within the hollow body interior partially obstructs the flow path when the body is run into the wellbore, and the deformable material is displaceable to expand the body into the downhole space and to open the body flow path. Such material can be displaced with a setting tool or with mechanical movement of the body components. A second body section can be moved relative to a first body section to displace the deformable material from the body interior. The second body section can initially be discontinuous with the first body section to permit installation through narrow wellbore spaces and can be connected downhole to create a unitary body structure.

16 Claims, 3 Drawing Sheets

HIGH EXPANSION DOWNHOLE PACKER

BACKGROUND OF THE INVENTION

The present invention relates to the field of downhole packers. More particularly, the present invention relates to an expandable packer for obstructing a space between downhole well components or between well tubing and a wellbore casing or open wellbore surface.

Downhole packers seal the annulus between well tubing and the wellbore, and between well tubing and casing set in the wellbore. By sealing such annulus, hydrocarbon producing zones can be isolated from other regions within a wellbore, thereby preventing migration of fluid or pressure between zones.

Packers typically comprise permanent or retrievable packers. Permanent packers are installed in the wellbore with mechanical compression setting tools, fluid pressure devices, inflatable charges, or with cement or other materials pumped into an inflatable seal element. Because of the difficulty of removing permanent packers, retrievable packers have been developed to permit the deployment and retrieval of the packer from a particular wellbore location.

Conventional packers typically comprise a sealing element between upper and lower retaining rings or elements. U.S. Pat. No. 4,753,444 to Jackson et al. (1988) disclosed a packer having a conventional sealing element located around the outside of a mandrel. Anti-extrusion rings and back-up rings contained the seal element ends and were compressed to radially expand the seal element outwardly into contact with the well casing. U.S. Pat. No. 4,852,649 to Young (1989) disclosed packers having multiple moving packer elements which distributed stresses across the elements as the packer elements expanded to seal the wellbore annulus. In U.S. Pat. No. 5,046,557 to Manderscheid (1991), multiple seal elements were separated with spacers around the exterior surface of a mandrel. The seal elements were hydraulically set to contact the well casing.

Other concepts have been developed for specific seal requirements. In U.S. Pat. No. 5,096,209 to Ross (1992), voids were incorporated within sealing elements to modify the performance of the seal elements in the sealing gaps between multiple tubing elements. In U.S. Pat. No. 5,195,583 to Toon et al. (1993), bentonite was placed within a packer element so that contact with water caused seal element expansion to form a low pressure annular seal.

U.S. Pat. No. 5,467,822 to Zwart (1995) disclosed a fluid pressure set pack-off tool wherein a seal element was retained with rings and annular inserts. Coaxial springs reduced distortion of the seal element and facilitated retraction of the seal element following removable of the fluid pressure. Radial bores through the seal element prevented entrained air from distorting the seal element and further permitted a higher pressure to press the seal element into sealing engagement with the well casing.

One limitation of conventional packers is that the exterior sealing element travels on the packer exterior from the well surface to the downhole location. When the packer is run thousands of meters into the wellbore, the packing seal can abrade or completely swab off the packer sleeve. This failure may not be detected until the packer is set and the pressure containment of the isolated zone fails.

Another limitation of conventional packers is the requirement for packers having high expansion capabilities. High expansion packers are often required below tubing and other restrictions in a wellbore to isolate lower production or well treatment zones. If a tubing string is established in a wellbore with a primary packer to seal the annulus between the wellbore and the tubing exterior surface, an additional packer may be run through the tubing interior space to a wellbore location downhole of the primary packer. If the additional packer is located past the tubing string end, such packer must expand from the thin through-tubing dimension to fill the larger wellbore annulus.

To accomplish high expansion capabilities, conventional inflatable packers have been modified to meet the expandability requirements. Inflatable packers having expandible back-up rings have been created to provide high expansion capabilities for such applications, such as U.S. Pat. No. 3,706,342 to Woolley (1972). In Woolley, the sealing element was positioned about a central tube, and was expanded with overlapping finger elements. Such conventional compression style seal elements are constrained by complex anti-extrusion backup systems, extreme buckling of the sealing element, and excessively long setting strokes.

Accordingly, a need exists for a high expansion packer that avoids the disadvantages of conventional packers and provides a reliable seal between different components and features downhole in a wellbore.

SUMMARY OF THE INVENTION

The present invention provides an expandable apparatus for filling a space downhole in a wellbore. The apparatus comprises an expandable body having a hollow interior which defines an open flow path through the body, and a deformable material within the hollow interior for at least partially obstructing the flow path when the body is moved within the wellbore. The deformable material is displaceable to expand the body into the space and to open the flow path through the body.

In another embodiment of the invention, the body can comprise a first body section and a second body section moveable relative to the first body section. Each body section has a hollow interior defining an open flow path through the body sections. A deformable sheath attached to the first and second body sections at least partially defines an interior volume for the deformable material, and the deformable material is displaceable to move the sheath into the wellbore space and to open the flow path through the body sections. In another embodiment of the invention, a connector attaches the second body section to the first body section after the deformable material is displaced from the interior volume. This embodiment permits the apparatus to be run into the wellbore and to be assembled for use downhole in the wellbore.

DESCRIPTION OF THE PREFERRED EMBODIMENTS

The present invention uniquely provides a novel apparatus capable of expanding a packing element into a downhole wellbore space. Although the terms "packer" and "packing element" are used herein, the invention can provide the function of a packer, a bridge plug, a straddle or other function requiring obstruction of a space between a wellbore tool and a casing or open wellbore, or between different tool surfaces.

Figure 1:
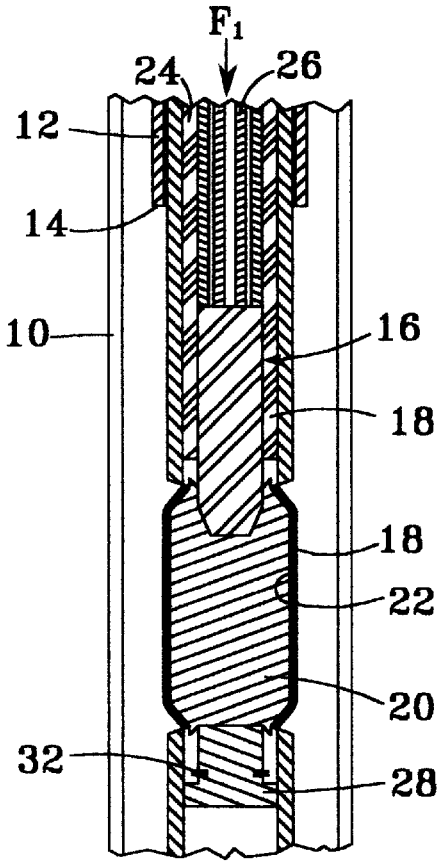
FIG. 1 illustrates a body and a deformable material within an interior volume of the body.

Referring to FIG. 1, wellbore 10 typically comprises a cylindrical wall surface located below the surface elevation. As used herein, the term "wellbore" means the interior wall of a casing pipe or the open hole wellbore through subsurface geologic formations. Although FIG. 1 illustrates a vertical orientation for wellbore 10 and references are made herein to downward and upward movement, it should be understood that wellbore 10 can be horizontal, slanted, or curved within the subsurface geologic formations.

Stationary tubing 12 is located within wellbore 10 and has lower terminal end 14. A setting tool such as wireline, coiled tubing, rod or other form of setting tool 16 is connected to expandable tool body 18 and is run through the interior of tubing 14. Deformable material 20 is positioned within the interior of tool body 18 as further described below.

Tool body 18 includes a deformable body section 22 in contact with deformable material 20. In the embodiment illustrated in FIG. 1, setting tool 16 comprises tubing section 24 having interior rod 26. Tool body 18 includes end cap 28 which defines one surface of interior volume 30 within tool body 18. Shear pin or ring 32 retains end cap 28 relative to tool body 18.

Figure 2:
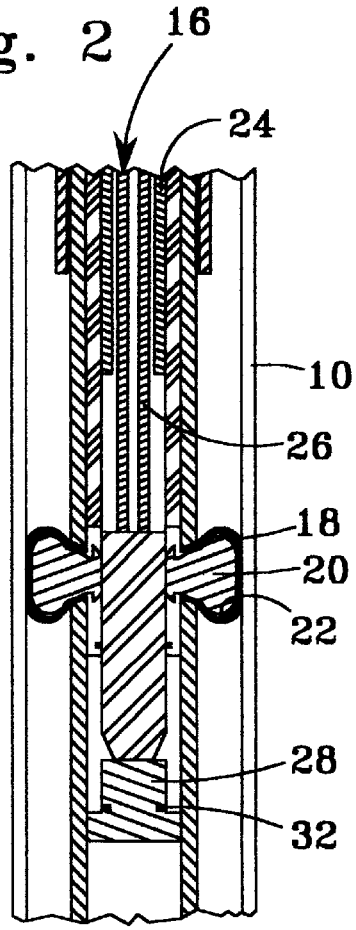
FIG. 2 illustrates the body after the deformable material has been displaced from the interior volume.
Figure 3:
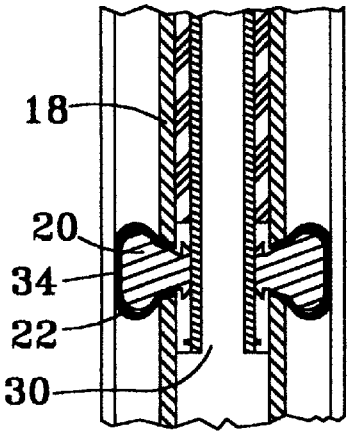
FIG. 3 illustrates the hollow interior volume through the body after the body has been set against the wellbore and the setting tool has been removed.

Tubing section 24 is anchored to resist movement, and interior rod 26 can be moved downwardly relative to tubing section 24 to provide setting force $F_1$ and to pressurize deformable material 20. Other setting tool embodiments, whether axial, radial or rotational in movement, can be used to move deformable material 20. At a selected pressure, deformable material 20 will displace to expand body 18 radially outwardly into the space between body 18 and wellbore 10. As this displacement continues, deformable material 20 will continue to radially expand body 18 until body 18 contacts wellbore 10 to seal the annulus between tubing section 24 and wellbore 10. Continued downward movement of interior rod 26 completes the desired displacement of deformable material 20 and exceeds the load capacity of shear ring 32, thereby severing end cap 28 from body 18 as shown in FIG. 2. Subsequent withdrawal of interior rod 26 opens the interior of body 18 to expose hollow interior volume 30 within body 18 as illustrated in FIG. 3. Hollow interior volume 30 was initially filled with deformable material 20 when body 18 was lowered through tubing 12, and was displaceable from hollow interior volume 30 to set body 18 against wellbore 10 and to create an open, through tubing flow path suitable for the passage of fluids or additional tools.

Expandable body section 22 is illustrated as a relatively thin walled tubular member formed from stainless steel, titanium, or other material having sufficient strength and elasticity to bend without fracturing. Although the thickness of body section 22 is illustrated as being relatively uniform in thickness, body section 22 can be designed so that the thickness of body section 22 varies or is shaped in different configurations with grooves, ridges, indentations, or protrusions to modify the deformation performance of body section 22. Different shapes will cause body section 22 to conform to variations in the shape of wellbore 10. Body section 22 can be constructed with a size and material which creates a permanent set position which stabilizes body 18 relative to wellbore 10, and wherein the setting force between body section 22 and wellbore 10 does not relax or shrink over time due to tool movement, thermal fluctuations within wellbore 10, or other factors adversely affecting the performance of conventional packer systems.

Deformable material 20 is positioned within hollow interior volume 30 to control the deformation of body section 22. In the absence of deformable material 20, body section 22 might tend to buckle, crimp or otherwise bend in a non-uniform manner. In a preferred embodiment of the invention, deformable material 20 deforms to uniformly transfer the motive force from Force $F_1$ uniformly against body section 22. In this embodiment of the invention, the deformation of body section 22 is influenced by the mass and structure of body section 22 and on the plastic performance of deformable material 20. This feature of the invention provides the benefit of permitting a relatively thin-walled body section 22 to be used, thereby providing significant plastic deformation without failure due to internal stresses within body 18. This deformation flexibility permits many unique applications of the invention, such as in the application to irregularly shaped wellbores.

Resilient material 34 can be attached to an exterior surface of body section 22. When body section 22 is deformed in the set position, resilient material 34 flexes or compresses to seal any gap between body section 22 and the interior wall of wellbore 10. In this embodiment of the invention, body section 22 and resilient material 34 cooperate to provide a unique packer element between tool 18 and wellbore 10.

Deformable material 20 can comprise a fluid, gel or liquid compound such as oil, gas, or other homogeneous material within interior volume 30. O-ring seals (not shown) can prevent leakage of deformable material 20 from interior volume 30. In other embodiments of the invention, deformable material 20 can also comprise a sintered material, pellets or loose particles within interior volume 30. Such loose particles can comprise a metallic, ceramic, plastic, or another suitable material. In all of these embodiments, deformable material 20 is reconfigured by setting tool 16 to assist in the deformation of expandable body section 22.

In addition to the inventive embodiments described above, it will be appreciated that other deformable compounds and material structures can provide the functions described above. Material 20 can partially or completely obstruct hollow interior volume 30 as tool body 18 is moved through tubing 12. This unique feature of the invention permits the storage of additional material 20 within body 18 as body 18 is run into the wellbore from the surface. Material 20 can be nonsetting or can harden to provide additional support for body 18 after body section 22 is deformed into the set position. Material 20 can be noncompressible or moderately or significantly compressible, provided that material 20 is sufficiently dense to transfer deformation forces to body section 22 or to prevent undesirable deformation of body section 22. While material 20 is illustrated as a relatively homogeneous material within interior volume 30, material 20 could comprise multiple or composite compounds or structures having different mass, density, shear strength, or other characteristics.

Force $F_1$ can be furnished by any setting tool capable of applying the requisite force against deformable material 20. The opposing force counteracting the setting force $F_1$ is provided by shear ring 32 in contact with body 18. Alternatively, such opposing force can be provided by the weight of tubing or other components, by friction between such components and casing wall, or by slips or another packer located in wellbore 10. In another embodiment of the invention, the opposing force can be provided by a detachable tool run in wellbore 10 which provides a force opposing Force $F_1$.

The invention is particularly advantageous over known packer systems because the thin wall of body section 22 is sufficiently elastic to conform to the wellbore surface 10, without losing the integral strength provided by body section 22. While conventional seal materials typically lose structural integrity as the seal element is expanded, body section 22 retains structural integrity and strength despite irregular deformation of body section 22 within an irregularly shaped wellbore surface. The mechanism for deforming body section 22 is initially concealed within interior volume 30 of body 18 as body 18 is run through the confined diameter of tubing 12, and is expandable outwardly to move body section 22 into engagement with wellbore 10. Because of this unique feature, tool body 18 and body section 22 can seal wellbore 10 against extremely high well fluid pressures downhole from a tubing string installed within wellbore 10.

Figure 4:
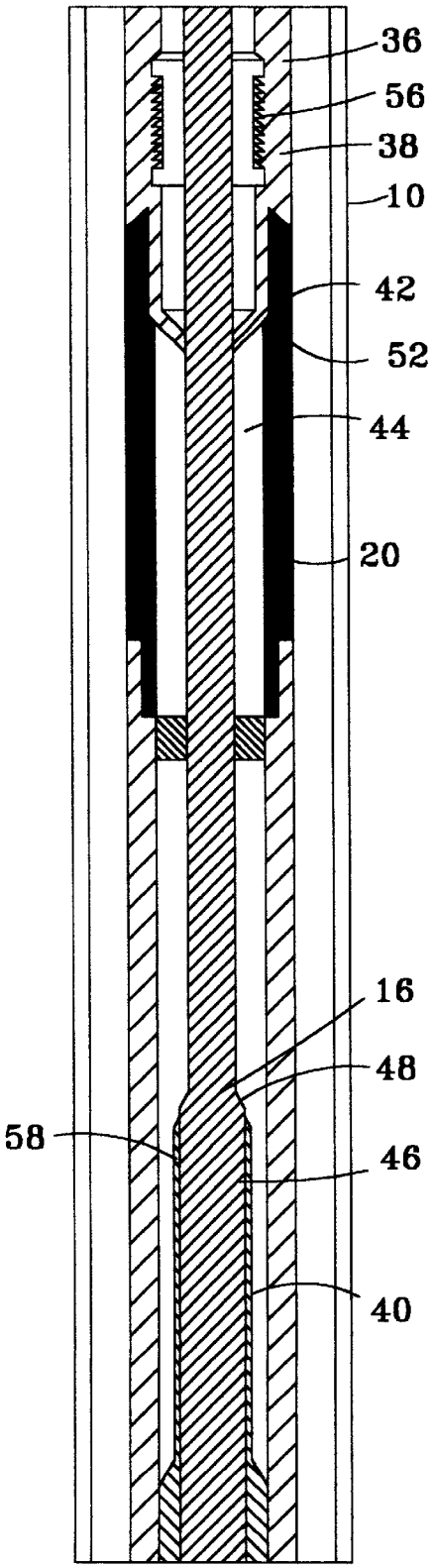
FIG. 4 illustrates an embodiment where the body comprises a first body section and a second body section.

FIG. 4 illustrates another embodiment of the invention wherein the tool body 36 includes first body section 38 and second body section 40 attached to deformable sheath 42. First body section 38, second body section 40 and sheath 42 cooperate to form interior volume 44 partially filled with deformable material 20. Setting tool 16 includes swage 46 having bevel 48 and being connected to rod 50. Cone 52 is positioned about the exterior circumference of rod 50 and contains deformable material 20 from entering the annulus between rod 50 and the interior wall of tubing 12.

Figure 5:
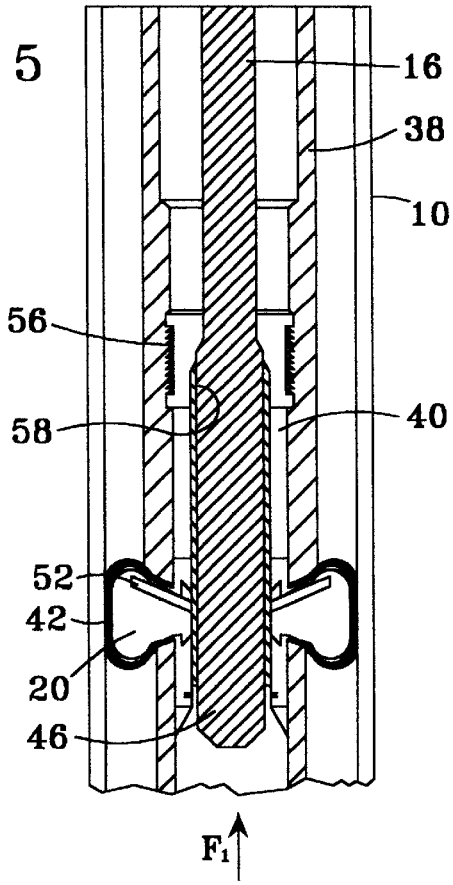
FIG. 5 illustrates the embodiment of FIG. 4 in an expanded configuration where the first and second body sections are connected.
Figure 6:
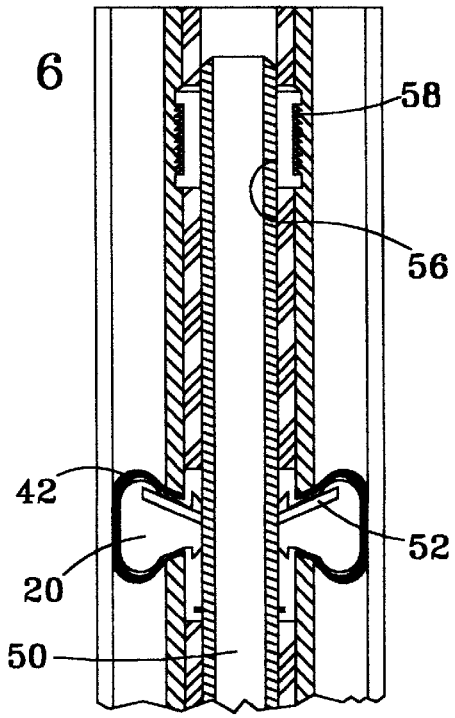
FIG. 6 illustrates an open flow path through the tool body.

Rod 50 can be withdrawn from wellbore 10, causing bevel 48 to contact deformable material 20 and to displace deformable material 20 from interior volume 44. Such displacement moves sheath 42 radially outwardly until sheath 42 engages wellbore 10. Continued withdrawal of rod 50 moves cone 52 radially outwardly as shown in FIG. 5 until rod 50 and swage 46 are removed from wellbore 10 to leave hollow flow path 54 through first body section 38 and second body section 40, as shown in FIG. 6. The invention utilizes the interior volume or 44 to initially contain deformable material 20 before installation, and creates unobstructed flow path 54 to permit the flow of fluids or movement of tools therethrough.

As shown in FIG. 5, second body section 40 is connected or otherwise interlocked or engaged with first body section 38 to lock the relative position of such tool components. In one embodiment of this connection as illustrated, teeth 56 on first body section 38 are engaged with teeth 58 on second body section 40. This embodiment of the invention retains deformable material 20 within the reconfigured volume behind sheath 42, and prevents additional movement of material 20.

This connective feature between first body section 38 and second body section 40 uniquely permits the tool to be run into wellbore 10 in an unassembled condition, and to assemble the tool downhole at the desired location within wellbore 10. This feature of the invention permits an apparatus configuration which permits transport through a relatively slim interior of tubing 12, and permits maximum expandability into engagement with wellbore 10 after the apparatus exits tubing 12.

Figure 7:
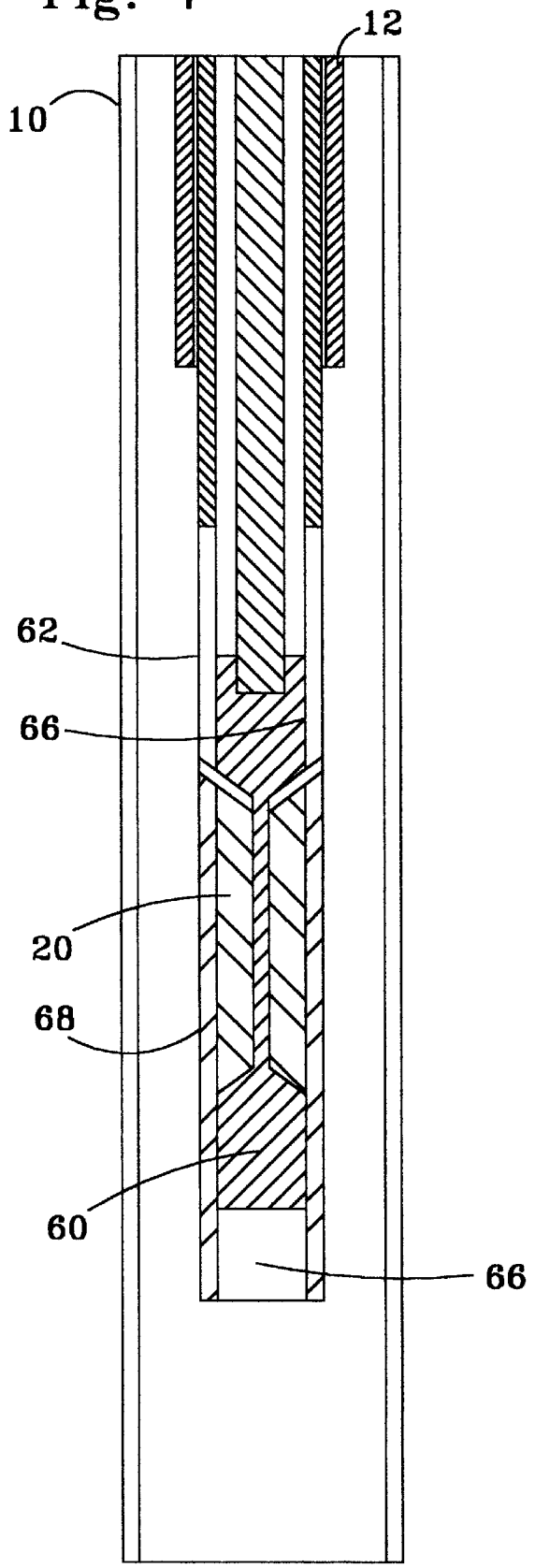
FIG. 7 illustrates an embodiment of the invention wherein the second body section is rotated relative to the first body section to displace the deformable material.

In alternative embodiments of the invention, the packer elements or sheaths can be set in other ways without departing from the inventive concepts disclosed herein. As shown in FIG. 7, body second section 60 is rotatable relative to body first section 62 to displace deformable material 20 from interior volume 64. Such rotatable engagement can be accomplished with threaded connection 66 as illustrated in FIG. 7, or by other mechanical configurations or combinations suitable for displacing material 20 to move sheath 68 into the space within wellbore 10. Sheath 68 can comprise a portion of deformable material 20, or can comprise a distinct member rotatably unattached to first body section 62 and second body section 60, or can be attached to first body section 62 as illustrated while being unattached to second body section 60.

In addition to the mechanical setting techniques described, other techniques can be applied to provide the setting mechanism for the invention. For example, hydraulic setting techniques or other techniques providing the requisite setting force could be configured to set the downhole elements. After the packer or sheath elements are set, the invention provides structural strength and stability resistant to pressure surges and downhole temperature fluctuations.

The invention is illustrated in a cylindrical wellbore 10 wherein the annulus between a cylindrical sleeve and the wellbore is sealed with annular backup rings or seal elements. However, the principles of the invention are adaptable to a multitude of downhole shapes. The thin wall of sheath or expandable body section, and the uniform motive force provided by the deformable material permit the extrusion of the sheath in many different shapes and configurations. Other shapes such as a planar space between adjacent tool surfaces, or irregular spaces between tool surfaces or a tool surface and the wellbore or casing wall can be filled by using the invention.

In other embodiments, the principles of the invention are adaptable to numerous downhole tools such as retrievable or permanent well plugs, through tubing mandrels, packers, and other well tools. The invention uniquely provides an apparatus and method which verifies the setting force of the elements, is not degraded by fluctuating pressures or temperatures, and which provides substantial flexibility in designing a settable element for a specific requirement.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

I claim:

1. An expandable apparatus for filling a space downhole in a wellbore, comprising:

an expandable body having a hollow interior which defines an open flow path through said body;

a deformable material within said hollow interior for at least partially obstructing said flow path when said body is moved into said wellbore, wherein said deformable material is displaceable to expand said body into the space and to open said flow path through said body.

2. An apparatus as recited in claim 1, wherein said body comprises a first body section, a second body section moveable relative to said first body section, and a deformable sheath between said first and second body sections.

3. An apparatus as recited in claim 2, wherein said deformable material completely obstructs said flow path when said body is moved into said wellbore.

4. An apparatus as recited in claim 1, wherein said hollow interior has a circular crossection.

5. An apparatus as recited in claim 1, wherein said apparatus comprises a packer, and wherein said body is expandable to seal a space between said body and an interior surface of the wellbore.

6. An apparatus as recited in claim 1, wherein said deformable material is displaceable by a tool moveable through said hollow interior.

7. An apparatus as recited in claim 1, wherein said deformable material is displaceable by a tool axially moveable through said hollow interior in a direction parallel to a longitudinal axis through said body.

8. An apparatus as recited in claim 1, wherein said body and said deformable material have exterior dimensions sufficiently small to permit the movement of said body and said deformable material through a tubing positioned within the wellbore, and wherein said deformable material is displaceable to expand said body into contact with the wellbore after said body and said deformable material have exited the tubing.

9. An apparatus for filling a space downhole in a wellbore, comprising:

a first body section having a hollow interior about a longitudinal axis through said first body section which defines an open flow path through said body section;

a second body section moveable relative to said first body section and having a hollow interior about said longitudinal axis which defines an open flow path through said second body section;

a deformable sheath having a first end attached to said first body section and having a second end attached to said second body section, wherein said sheath at least partially defines an interior volume proximate to said first body section and said second body section; and a deformable material within said interior volume for moving said sheath into the downhole wellbore space when the sheath second end moves relative to said sheath first end, wherein said second body section is attachable to said first body section after said deformable material is displaced.

10. An apparatus as recited in claim 9, wherein said deformable material has an opening for permitting the insertion of a setting tool therethrough, and wherein the setting tool is moveable relative to said deformable material for displacing siad deformable material to move said sheath into the downhole wellbore space.

11. An apparatus as recited in claim 10, further comprising a shear pin for initially retaining the setting tool relative to said second body section, and for selectively releasing the setting tool to move relative to said deformable material.

12. An apparatus for filling a space downhole in a wellbore, comprising:

a first body section having a hollow interior about a longitudinal axis through said first body section which defines an open flow path through said first body section;

a second body section moveable relative to said first body section;

a deformable sheath between said first body section and said second body section for at least partially defining an interior volume proximate to said first body section and to said second body section;

a deformable material within said interior volume for moving said sheath into the downhole wellbore space when said second body section moves relative to said first body section, wherein said deformable material is displaceable to open said flow path through said first body section; and a connector for attaching said second body section to said first body section after said deformable material is displaced from said interior volume.

13. An apparatus as recited in claim 12, wherein said second body section has a hollow interior about said longitudinal axis which continues said open flow path through said second body section.

14. An apparatus as recited in claim 13, wherein said deformable material is displaceable from said interior volume by a setting tool moving through said interior volume.

15. An apparatus as recited in claim 13, wherein said first body section and said second body section substantially comprise thin wall cylinders.

16. An apparatus as recited in claim 12, wherein said connector is integrated into said first body section and into said second body section.

* * * * *